US008656672B2

(12) United States Patent
Quinn

(10) Patent No.: US 8,656,672 B2
(45) Date of Patent: Feb. 25, 2014

(54) SYSTEMS AND METHODS OF REVITALIZING STRUCTURES USING INSULATED PANELS

(75) Inventor: James G. Quinn, Arnold, MD (US)

(73) Assignee: James C. Quinn, Arnold, MD (US)

( * ) Notice: Subject to any disclaimer, the term of this patent is extended or adjusted under 35 U.S.C. 154(b) by 0 days.

(21) Appl. No.: 12/980,496

(22) Filed: Dec. 29, 2010

(65) Prior Publication Data

US 2011/0154761 A1 Jun. 30, 2011

Related U.S. Application Data

(60) Provisional application No. 61/291,302, filed on Dec. 30, 2009, provisional application No. 61/293,854, filed on Jan. 11, 2010.

(51) Int. Cl.
*E04C 1/00* (2006.01)

(52) U.S. Cl.
USPC ..... 52/309.7; 52/309.2; 52/404.2; 52/481.1

(58) Field of Classification Search
USPC ..... 52/309.1, 309.2, 309.4, 309.7, 309.16, 52/404.2, 404.4, 475.1, 483.1, 481.1
See application file for complete search history.

(56) References Cited

U.S. PATENT DOCUMENTS

| | | | | |
|---|---|---|---|---|
| 2,142,305 | A | 1/1939 | Davis | |
| 3,400,958 | A | 9/1968 | Haimes | |
| 3,992,839 | A | 11/1976 | La Borde | |
| 4,284,447 | A * | 8/1981 | Dickens et al. | 156/78 |
| 4,288,951 | A * | 9/1981 | Carlson et al. | 52/94 |
| 4,404,889 | A | 9/1983 | Miguel | |
| 4,435,939 | A | 3/1984 | Hird | |
| 4,458,462 | A | 7/1984 | Schold | |
| 4,534,141 | A | 8/1985 | Fagnoni | |
| 4,566,558 | A * | 1/1986 | Link et al. | 181/210 |
| 4,780,039 | A * | 10/1988 | Hartman | 411/531 |
| 4,822,657 | A | 4/1989 | Simpson | |
| 4,953,334 | A * | 9/1990 | Dickens | 52/309.4 |
| 5,014,478 | A | 5/1991 | Spring | |
| 5,060,582 | A | 10/1991 | Salzer | |
| 5,083,410 | A | 1/1992 | Watson | |

(Continued)

FOREIGN PATENT DOCUMENTS

| | | |
|---|---|---|
| EP | 1333129 | 8/2003 |
| GB | 2478907 | 9/2011 |
| WO | WO02/25024 | 3/2002 |
| WO | WO2012/012688 | 1/2012 |

OTHER PUBLICATIONS

U.S. Appl. No. 12/403,953, Colliflower et al.

*Primary Examiner* — Brian Glessner
*Assistant Examiner* — Brian D Mattei
(74) *Attorney, Agent, or Firm* — Remenick PLLC

(57) ABSTRACT

A system for revitalizing an existing structure and a method of using the system are disclosed. The system includes an insulating panel that has a body and reinforcing metal strips. The system also includes at least one fastening strap coupled to the insulating panel, the fastening strap has at least one recess having a hole. The system also has at least one fastening device that passes through the hole in the recess of the fastening strap and secures the at least one fastening strap and the insulating panel to the existing structure. The recesses of the fastening strap are positioned so that the fastening devices engage the body of the insulating panel.

11 Claims, 5 Drawing Sheets

(56) References Cited

U.S. PATENT DOCUMENTS

| | | | | |
|---|---|---|---|---|
| 5,165,816 | A | 11/1992 | Parasin | |
| 5,185,195 | A | 2/1993 | Harpell et al. | |
| 5,257,583 | A | 11/1993 | Koenig | |
| 5,370,034 | A | 12/1994 | Turner et al. | |
| 5,469,796 | A | 11/1995 | Koenig | |
| 5,502,939 | A | 4/1996 | Zadok et al. | |
| 5,596,844 | A | 1/1997 | Kalinowski | |
| 5,724,782 | A | 3/1998 | Rice et al. | |
| 5,758,461 | A | 6/1998 | McManus | |
| 5,767,435 | A | 6/1998 | Reymann | |
| 5,799,462 | A * | 9/1998 | McKinney | 52/742.13 |
| 5,966,956 | A | 10/1999 | Morris et al. | |
| 5,970,675 | A | 10/1999 | Schray | |
| 6,082,240 | A | 7/2000 | Middione et al. | |
| 6,253,498 | B1 | 7/2001 | Fanucci | |
| 6,339,905 | B1 | 1/2002 | Craig | |
| 6,408,594 | B1 * | 6/2002 | Porter | 52/794.1 |
| 6,532,857 | B1 | 3/2003 | Shih et al. | |
| 6,647,689 | B2 | 11/2003 | Pletzer et al. | |
| 6,698,157 | B1 * | 3/2004 | Porter | 52/794.1 |
| 6,826,996 | B2 | 12/2004 | Strait | |
| 6,945,064 | B2 | 9/2005 | Jebaraj | |
| 7,086,209 | B1 | 8/2006 | Pruitt et al. | |
| 7,117,645 | B2 | 10/2006 | Bzorgi | |
| 7,520,205 | B1 | 4/2009 | Colliflower et al. | |
| 7,818,939 | B2 | 10/2010 | Bearinger et al. | |
| 7,882,659 | B2 | 2/2011 | Gyory et al. | |
| 7,966,775 | B2 | 6/2011 | Medley | |
| 8,136,303 | B2 | 3/2012 | Scott, IV | |
| 8,146,314 | B2 | 4/2012 | Nguyen | |
| 8,156,690 | B2 | 4/2012 | Higley | |
| 2006/0117689 | A1 * | 6/2006 | Onken et al. | 52/309.7 |
| 2007/0039262 | A1 | 2/2007 | Forgy | |
| 2008/0083180 | A1 * | 4/2008 | Miller | 52/309.4 |
| 2009/0188181 | A1 | 7/2009 | Forbis et al. | |
| 2009/0223144 | A1 | 9/2009 | Leahy | |
| 2009/0272060 | A1 | 11/2009 | Lucchesi | |
| 2010/0154331 | A1 * | 6/2010 | Dickens | 52/220.1 |
| 2010/0319285 | A1 | 12/2010 | Jewett et al. | |
| 2010/0325971 | A1 | 12/2010 | Leahy | |
| 2010/0325989 | A1 | 12/2010 | Leahy | |
| 2011/0000014 | A1 | 1/2011 | Ball et al. | |
| 2011/0047912 | A1 | 3/2011 | Armijo | |
| 2011/0132421 | A1 | 6/2011 | Dolsby et al. | |
| 2011/0154761 | A1 | 6/2011 | Quinn | |
| 2011/0179745 | A1 | 7/2011 | Herron | |

* cited by examiner

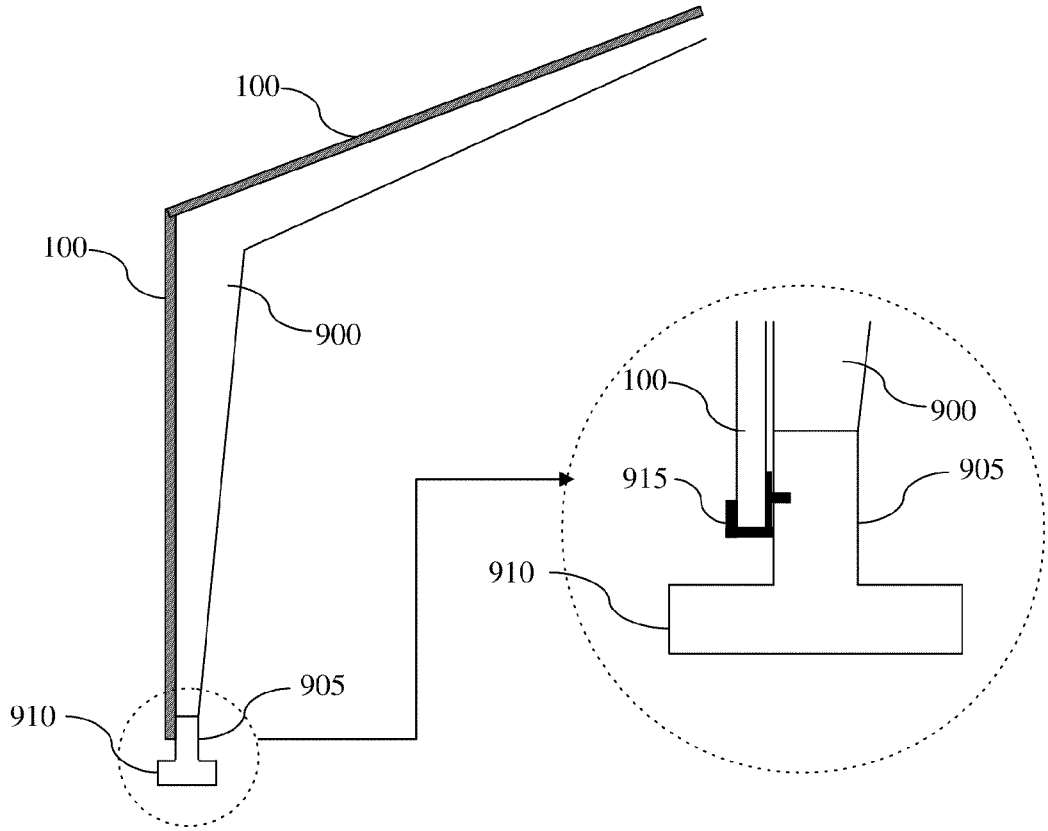
Figure 9a
Figure 9b
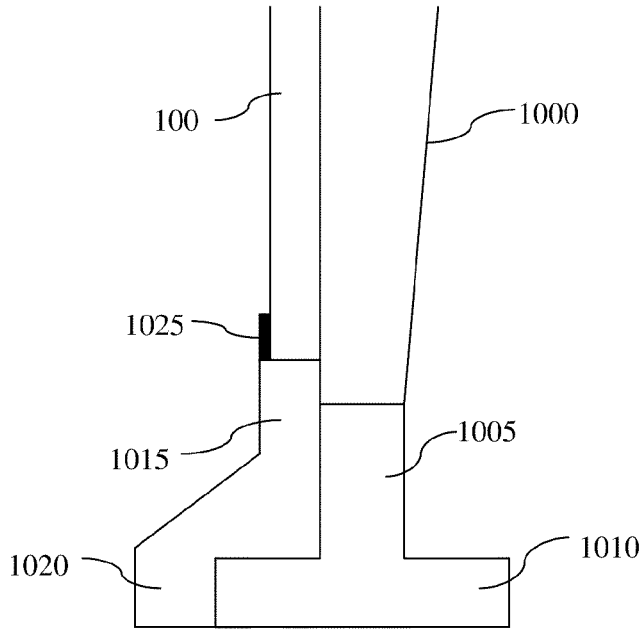
Figure 10

SYSTEMS AND METHODS OF REVITALIZING STRUCTURES USING INSULATED PANELS

REFERENCE TO RELATED APPLICATIONS

This application claims priority to U.S. Provisional Application Ser. No. 61/291,302, filed Dec. 30, 2009, and U.S. Provisional Application Ser. No. 61/293,854, filed Jan. 11, 2010 both entitled "Systems and Methods of Revitalizing Structures using Insulated Panels," which are hereby specifically and entirely incorporated by reference.

BACKGROUND

1. Field of the Invention

The invention is directed to systems and methods of revitalizing structures and, in particular, systems and methods of revitalizing structures to be energy efficient using insulated panels.

2. Background of the Invention

Global warming, high energy costs, lack of reusable sources of energy, and diminishing resources of fossil fuels are all reasons, among others, to improve the energy efficiency structures. Older buildings, such as houses, hangers, office buildings, and warehouses, for example, are usually energy inefficient, losing hot and/or cool air though the various surfaces, windows, doors, and other components.

In order to improve the energy efficiency of these older buildings it is often necessary to upgrade the buildings by increasing the structural strength of the building and retrofitting the building with energy efficient materials. Such upgrading is costly and time consuming.

Low cost insulating panels, such as those disclosed in U.S. Pat. No. 4,953,334 (incorporated in its entirety herein), provide reinforcing strips on one side of the panel. Once installed, these panels are apt to bow away from the reinforcing strips, thereby allowing gaps between the panels and the building surfaces and, thus, reducing the insulating capacity of the panels by allowing air to escape.

Other panels, such as those disclosed in U.S. Pat. Nos. 4,241,555, 4,284,477, and 4,653,718 (all of which are incorporated in their entirety herein), have the proper support on both sides of the panels however are difficult and time consuming to install. In order to install these panels onto an existing structure, a drill tip screw is necessary to drill through the panels as well as the reinforcing strips on either side of the panel. Furthermore, the drill tip screw requires a large hexagonal head to allow the proper torsion to be applied to the screw to drill through the reinforcing strips. The large hexagonal head, once installed, sticks out of the panel and prevents a finishing surface from being applied to the panels.

Therefore, it is desirable to have systems and methods of revitalizing a structure using the existing infrastructure by installing insulating panels that is cost effective and easy to install. It is also desirable to have systems and methods of revitalizing structures where the fastening devices used to secure the insulating panels to the structure do not protrude beyond the outer surface of the panels.

SUMMARY OF THE INVENTION

The present invention overcomes the problems and disadvantages associated with current strategies and designs and provides new systems and methods of revitalizing structures.

One embodiment of the invention is directed to a system for revitalizing an existing structure. The system includes an insulating panel, at least one fastening strap, and at least one fastening device. The insulating panel is comprised of a body and reinforcing metal strips. The fastening straps are coupled to the insulating panel and comprised of at least one recess having a hole. The fastening devices pass through the hole in the recess of the fastening strap and secure the fastening straps and the insulating panel to the existing structure. The recess of the fastening strap is positioned so that the at least one fastening device engages the body of the insulating panel.

In the preferred embodiment, the fastening devices do not engage the reinforcing metal strips. Preferably there is a plurality of insulating panels coupled to the structure in rows. The system further comprises one of a panel joiner and/or a panel joint fastener that couples the adjoining rows of panels.

In the preferred embodiment, the fastening strap further comprises at least one extension that engages the body of the insulating panel. Preferably the fastening strap is "C" shaped and the fastening strap is as long as the panel is wide. The panel is preferably comprised of a material chosen from polystyrene, fiberglass, urea-formaldehyde, cellulous, polyethylene, and combinations thereof. In the preferred embodiment the reinforcing strips are coupled to at least two faces of the panel and at least two edges of the panel are grooved.

Another embodiment of the invention is directed to a method of revitalizing an existing structure. The method includes the steps of placing a plurality of insulating panels adjacent to the existing structure, coupling at least one fastening strap to each panel, and fastening each fastening strap and each panel to the structure with a fastening device.

In the preferred embodiment, the plurality of panels are placed in rows of panels. Preferably, the rows of panels are staggered. The method preferably further comprises positioning at least one panel joiner and/or panel joint fastener between the rows of panels. Each fastening strap preferably comprises at least one recess having a hole and each panel preferably has reinforcing strips. In the preferred embodiment, each fastening strap is aligned so that the recesses do not align with the reinforcing strips. Preferably, the fastening devices to not engage the reinforcing strips. Each fastening strap preferably comprises at least one extension. The method preferably, further comprises inserting the at least one extension into the panel. In a preferred embodiment, at least one panel is coupled to the existing structure by placing the panel within a channel or track coupled to a stem wall of the existing structure.

Another embodiment of the invention is directed to a method of manufacturing two insulated panels from a single panel. The single panel preferably has two faces. The method includes the steps of arranging one C shaped stud, one L shaped leading edge, and at least one C shaped reinforcing strap for each face of the single panel, inserting insulating material between the C shaped stud, the L shaped leading edge, and the at least one C shaped reinforcing strap of each face of the single panel, allowing the insulating material to set, and dividing the single panel into two panels.

Preferably the two faces of the single panel are mirror images of each other and the two panels are substantially identical to each other. In the preferred embodiment, the single panel is divided into two panels by at least one of a saw, a knife, a hot wire, a laser, and a water jet.

Another embodiment of the invention is directed to an insulated panel adapted to be divided into two substantially identical panels. The single panel includes a body made of insulating material, and two faces each having one C shaped stud, one L shaped leading edge, and at least one C shaped reinforcing strap. Preferably, the first face and the second face are mirror images of each other.

DESCRIPTION OF THE DRAWINGS

The invention is described in greater detail by way of example only and with reference to the attached drawings, in which:

FIGS. 9*a*, 9*b*, and 10 depict embodiments of panels attached to existing buildings.

DESCRIPTION OF THE INVENTION

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention.

A problem in the art capable of being solved by the embodiments of the present invention is revitalizing a structure using the existing infrastructure to improve the energy efficiency of the structure using insulating panels. It has been surprisingly discovered that by using "C" shaped brackets, the insulating panels can be installed onto the existing infrastructure more easily and quickly than without the brackets. Furthermore, "H" shaped connectors provide additional support to adjoining panels.

Figure 1:
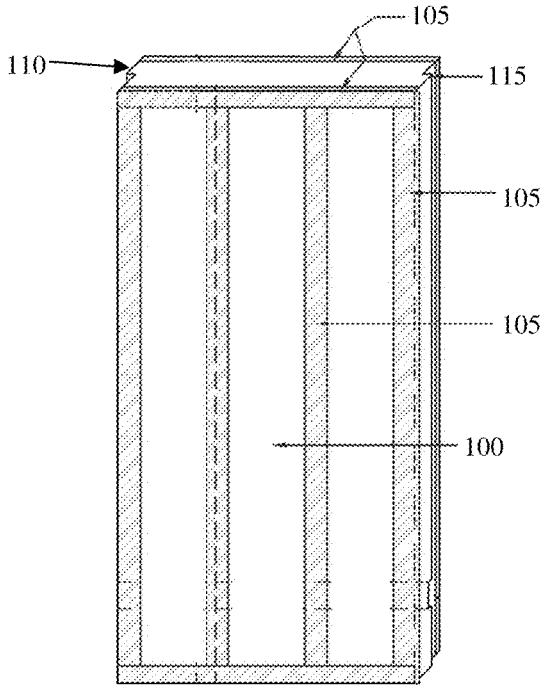
FIG. 1 depicts an exemplary panel for use in the system and method of the invention.

FIG. 1 depicts an exemplary panel 100 that can be used in the invention. In the preferred embodiment, panel 100 is comprised of a polystyrene core; however, other insulating materials such as, but not limited to, fiberglass, urea-formaldehyde, cellulous, and polyethylene can be used. Panel 100 is preferably also made of a fire retardant material. In the preferred embodiment, panel 100 is rectangular in shape and preferably has a maximum dimension of 4 feet in width by 12 feet in length; however other shapes and sizes are possible. Preferably, panel 100 has a thickness of either 3.5 inches, 5.5 inches, or 7.5 inches; however other thicknesses are possible. In the preferred embodiment, panel 100 weighs no more than 1.625 pounds per square foot; however other weights are possible.

Panel 100 is preferably reinforced with metal strips 105. In the preferred embodiment, metal strips 105 are secured to panel 100 along each edge of panel 100, as well as in intermediary locations on the surface of panel 100. However, in certain embodiments, metal strips 105 may be only secured to the edges of panel 100, the surface of panel 100, or combinations thereof. Furthermore, in the preferred embodiment, metal strips 105 are secured to panel 100 on both faces of panel 100. However, in certain embodiments, only one surface of panel 100 has metal strips 105. Preferably metal strips 105 are comprised of 24 gage galvanized G-90 steel, however other gages can be implemented and other materials, such as aluminum, stainless steel, carbon fiber, iron, plastic, wood, and synthetic materials can be used.

In the preferred embodiment, the long sides of panel 100 have grooved portions so that adjoining rows of panels 100 can be fitted together. As can be seen in FIG. 1, the left hand edge has a groove 110 running along the length of the upper surface while the right hand edge has a groove 115 running along the length of the lower surface. In the preferred embodiment, grooves 110 and 115 are adapted to mate with each other on adjoining rows of panels 100. This joint is known as an "L" joint or ship lap joint. In other embodiments, tongue and groove joints or other joints can be used.

Figure 2:
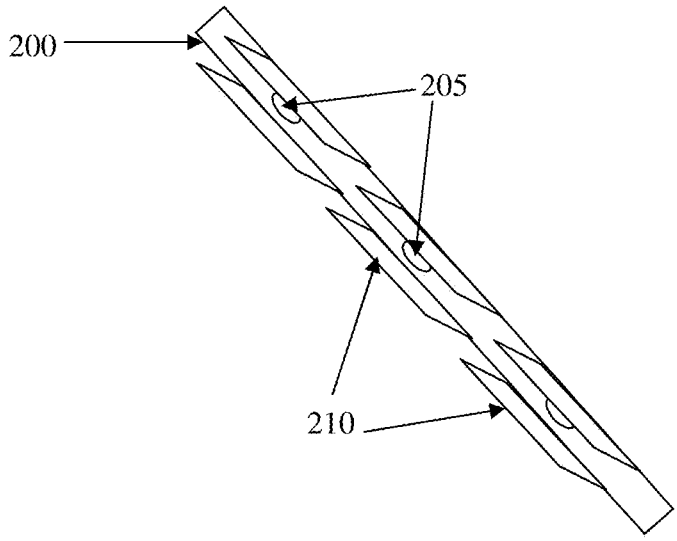
FIG. 2 depicts an embodiment of a fastening strap of the invention.

FIG. 2 depicts an embodiment of a fastening strap 200 of the invention. Fastening strap 200 is preferably a "C" shaped device used to couple panel 100 to the structure being revitalizing. In the preferred embodiment, fastening strap 200 is as long as panel 100 is wide; however other lengths can be used. Preferably, fastening strap 200 is between ½ inch and 1 inch wide; however other widths can be used.

Fastening strap 200 has at least one recess 205. In the preferred embodiment there is a plurality of recesses 205 equally spaced along fastening strap 200. Preferably, recesses 205 are deep enough so that the head of a fastening device, when fully engaged, is flush with the upper surface of fastening strap 200, e.g. ¼ to ½ inch deep. The fastening device is preferably a drill tip screw, however other fastening devices, such as, but not limited to, nails, bolts, and rivets, can be used. In the preferred embodiment, fastening devices are used to couple panels 100 to the walls and/or roof of an existing infrastructure by engaging the girders and/or purlins of the structure, respectively. However in other embodiments, panels 100 can be installed on new structures.

Figure 3:
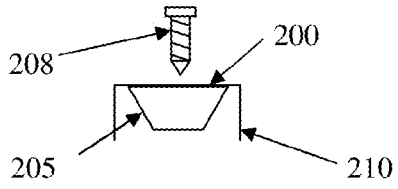
FIG. 3 depicts an end view of the fastening strap of FIG. 2.

Fastening strap 200 has extensions 210 extending from the upper surface of fastening strap 200 in the same direction as recesses 205. Preferably extensions 210 extend from both edges of fastening strap 200 and complete the "C" shape. FIG. 3 is an end view of fastening strap 200 showing a recess 205, the "C" shape, and a fastening device 208. There can be multiple extensions 210 per side of fastening strap 200 or one extension 210 per side of fastening strap 200.

Figure 4:
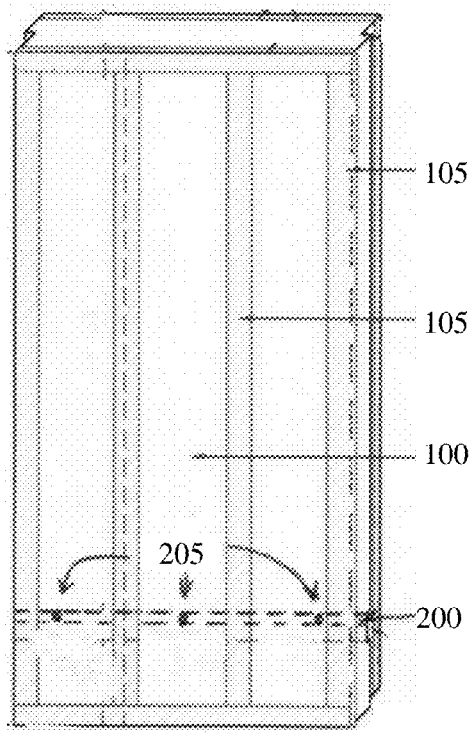
FIG. 4 depicts an embodiment of the system of the invention.

In the preferred embodiment, recesses 205 are positioned so that the fastening devices pass through strap 200 and engage the insulation portion of panel 100 without having to engage metal strips 105. FIG. 4 depicts a strap 200 positioned on panel 100 so that the fastening devices engage only the insulated portion of panel 100. Thus only the structure needs to be drilled into when installing the panels 100. While FIG. 4 depicts one strap 200, more than one strap 200 can be used. Additionally, straps 200 can be positioned at any point along the length of panel 100.

Figure 5:
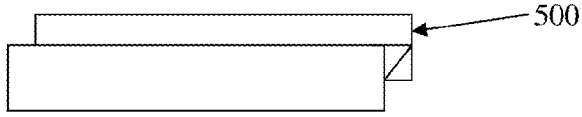
FIG. 5 depicts an embodiment of the panel joiner of the invention.

FIG. 5 shows a panel joiner 500 of the invention. Panel joiner 500 is preferably "H" shaped; however other shapes can be used. Panel joiner 500 is preferably comprised of plastic; however other materials, such as metal, wood, and rubber, can be used. In the preferred embodiment, panel joiner 500 is positioned between rows of panels 100 to add stability. Preferably, one half of the "H" fits over an edge of a first panel 100 and the other half of the "H" fits over an edge of an adjoining panel in the next row of panels. In the preferred embodiment, adjoining rows of panels are offset from the previous row so that the joints in one row do not line up with the joints in the next row. The arms of the "H" can be fastened to the panels by any method known in the art, including but not limited to screws, nails, adhesive, rivets, and bolts.

Preferably, panel joiner 500 is used in instances when the seam between two rows of panels is not above a truss, girder and/or purlin. Additionally, panel joiner 500 can be used in instances where the panels are coupled to a wall and the rows of panels are stacked atop one another.

Figure 6:
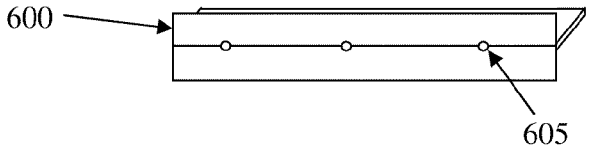
FIG. 6 depicts an embodiment of the panel joint fastener of the invention.

FIG. 6 shows a panel joint fastener 600 of the invention. Panel joint fastener 600 is preferably "T" shaped; however other shapes can be used. Panel joint fastener 600 is preferably comprised of metal; however other materials, such as plastic, wood, and rubber, can be used. In the preferred embodiment, panel joint fastener 600 is positioned between rows of panels 100 to add stability. Preferably, one half of the "T" fits over an edge of a first panel 100 and the other half of the "T" fits over an edge of an adjoining panel in the next row of panels. The arms of the "T" can be fastened to the panels by any method known in the art, including but not limited to screws, nails, adhesive, rivets, and bolts. In the preferred embodiment, adjoining rows of panels are offset from the previous row so that the joints in one row do not line up with the joints in the next row. Preferably, panel joint fastener 600 is used in instances when the seam between two rows of panels is above a truss, girder and/or purlin. Fastening devices, such as drill tip screw, nails, bolts, and rivets, can be used to secure panel joint faster 600 to the existing structure via holes 605.

FIGS. 9*a*, 9*b*, and 10 show two embodiments of attaching the bottom of a panel 100 to the existing structure 900. In FIG. 9*a*, panels 100 are attached to the walls and roof of an existing structure 900 having a stem wall 905 and footer 910 supporting the existing structure 900. In a preferred embodiment, as show in FIG. 9*b*, a J channel 915 is coupled to the stem wall 905 and supports panel 100 adjacent to the existing structure 900. While a slight gap is shown between panel 100 and existing structure 900, the gap is an exaggeration and in the preferred embodiment there is no gap. J channel 915 can be made of metal, plastic, wood, rubber, or other materials and is coupled to stem wall 905 by adhesive, screws, nails, rivets, friction, or other methods known in the art. Preferably, in this embodiment, non-structural panels 100 are used.

FIG. 10 shows another embodiment of attaching panels 100 to an existing structure 1000. Existing structure 1000 includes existing stem wall 1005 and existing footer 1010. In the preferred embodiment new stem wall 1015 and new footer 1020 are installed adjacent to existing stem wall 1005 and existing footer 1010. Preferably, new stem wall 1015 has a track 1025 on the upper surface into which panels 100 can be placed. Track 1025 can be made of metal, plastic, wood, rubber, or other materials and is coupled to new stem wall 1015 by adhesive, screws, nails, rivets, friction, or other methods known in the art. Preferably, in this embodiment, non-structural panels 100 are used.

Figure 7:
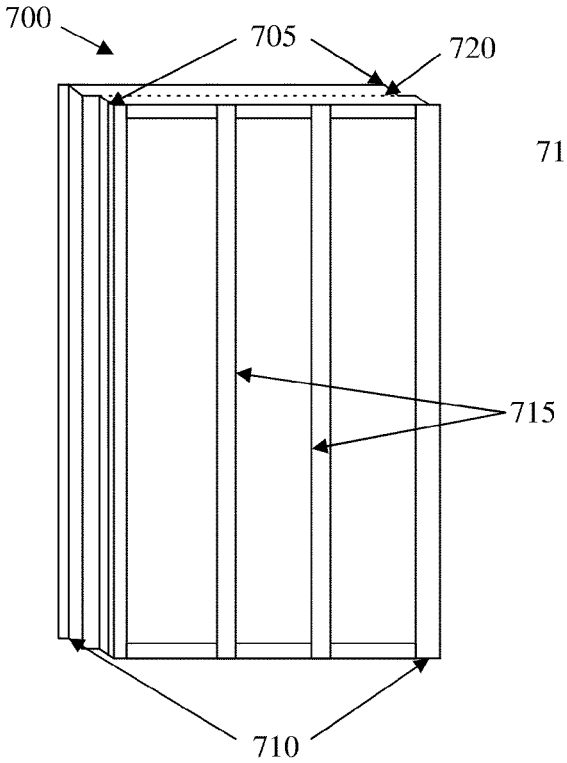
FIG. 7 depicts an embodiment of a panel for dividing in half.
Figure 8:
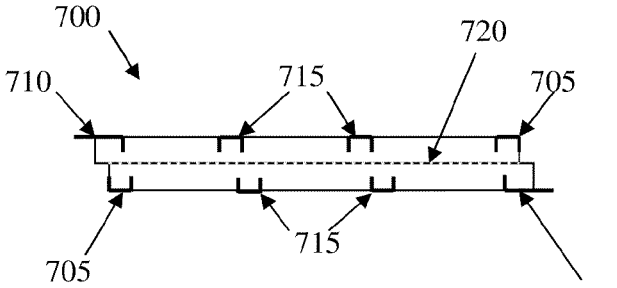
FIG. 8 depicts a top view of the panel of FIG. 7.

In some applications, it is desirable to have reinforcing strips on only one face of a panel. However during the manufacturing process of the panels, it is necessary to have reinforcing strips on both faces of a panel to prevent the panel from bowing or otherwise misshaping during the setting period. FIGS. 7 and 8 depict a front and a top view of a panel 700 that is used in an embodiment of a method of creating a panel having reinforcing strips only on one face. In the preferred embodiment, the front face of panel 700 is a minor image of the rear face of panel 700. Preferably, each face of panel 700 has one edge 705 having a "C" shaped stud and one edge 710 having an "L" shaped leading edge. Additionally, each face of panel 700 has at least one "C" shaped reinforcing strip 715.

In the preferred embodiment, panel 700 is formed by inserting the insulating material between the "C" shaped studs, the "L" shaped leading edges, and the "C" shaped reinforcing strips. The insulating material is allowed to set and then panel 700 is divided along division line 720. Preferably division line 720 is halfway between the two faces of panel 700. For example panel 700 can have a width of 7.5 inches and after division, each half will be 3.75 inches wide. Preferably, the two half panels will be substantially identical, each having one "C" shaped stud, one "L" shaped leading edge, and one or more "C" shaped reinforcing strip. Panel 700 can be divided by saw, hot wire, knife, laser, water jet, or other methods known in the art.

Figure 11:
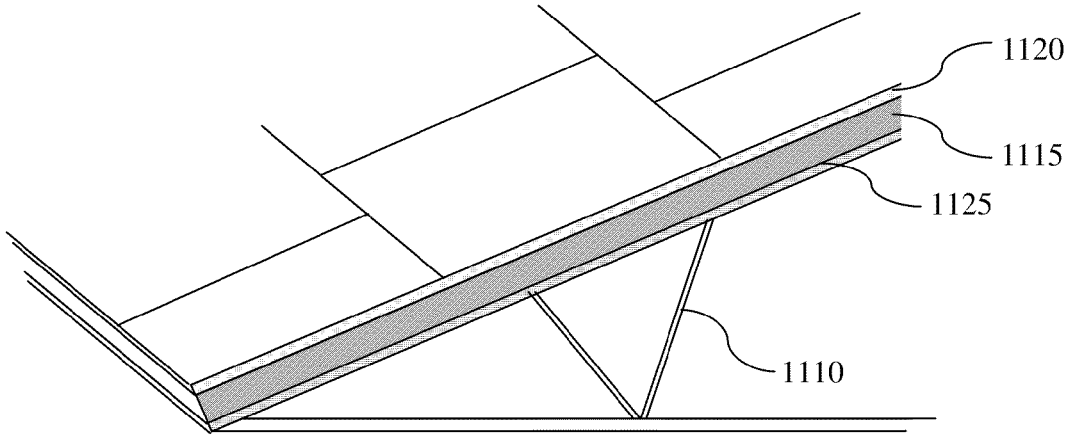
FIG. 11 depicts another embodiment of a panel attached to the roof of an existing building.

FIG. 11 depicts another embodiment of the invention. In FIG. 11, insulating panels are attached to the existing frame of 1110 of a building, for example on the roof. The panels are preferably comprised of an insulation layer 1115 and a structural layer 1120. For example, the insulation layer 1115 can be EPS foam, polystyrene, fiberglass, urea-formaldehyde, cellulous, or polyethylene, while the structural layer 1120 can be of oriented strand board, plywood, pressboard, metal, or plastic. Preferably the panels are installed over the existing structure (e.g. on top of the plywood and roof shingles 1125) by, for example, screws, nails, epoxy, other adhesives, rivets, bolts, or other attachment methods. Preferably, the panels are covered. For example, the panels can be covered in roof shingles, natural or artificial siding, camouflage, or other building facades.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising" includes the terms "consisting of" and "consisting essentially of," and the terms comprising, including, and containing are not intended to be limiting.

The invention claimed is:

1. A system for revitalizing an existing structure, comprising:

an insulating panel comprising a body;

a frame of edge reinforcing metal strips, each edge reinforcing metal strip coupled to an edge of the body;

at least one central reinforcing metal strip, each central reinforcing metal strip coupled to a face of the body;

at least one centrally located fastening strap coupled to a face of the body and overlapping two edge reinforcing metal strips and each central reinforcing metal strip, wherein the at least one fastening strap is perpendicular to the at least one central reinforcing metal strip and comprises at least one countersink having a preformed hole; and at least one fastening device passing through the preformed hole in the countersink of the fastening strap and securing the at least one fastening strap and the insulating panel to the existing structure;

wherein the at least one countersink of the fastening strap is positioned so that the at least one fastening device engages the body of the insulating panel between the edge reinforcing metal strips and the at least one central reinforcing metal strip without engaging the reinforcing metal strips.

2. The system of claim 1, wherein there is a plurality of insulating panels coupled to the structure in rows.

3. The system of claim 2, further comprising at least one of a panel joiner or a panel joint fastener coupling adjoining rows of panels.

4. The system of claim 1, wherein the fastening strap further comprises at least one extension engaging the body of the insulating panel.

5. The system of claim 4, wherein the fastening strap is at least partially C shaped.

6. The system of claim 1, wherein the fastening strap is as long as the panel is wide.

7. The system of claim 1, wherein the panel is comprised of a material chosen from polystyrene, fiberglass, urea-formaldehyde, cellulous, polyethylene, and combinations thereof.

8. The system of claim 1, wherein the reinforcing strips are coupled to at least two faces of the panel.

9. The system of claim 1, wherein at least two edges of the panel are grooved.

10. The insulated panel of claim 1, further comprising at least one L shaped leading edge extending beyond an end surface of the body.

11. A system for revitalizing an existing structure, comprising:

an insulating panel comprising a body;

a frame of edge reinforcing metal strips, each edge reinforcing metal strip coupled to an edge of the body;

at least one central reinforcing metal strip, each central reinforcing metal strip coupled to a face of the body;

at least one centrally located fastening strap coupled to a face of the body and overlapping two edge reinforcing metal strips and each central reinforcing metal strip, wherein the at least one fastening strap is perpendicular to the at least one central reinforcing metal strip; and at least one fastening device passing through the at least one fastening strap and securing the at least one fastening strap and the insulating panel to the existing structure;

wherein the at least one fastening device engages the body of the insulating panel between the edge reinforcing metal strips and the at least one central reinforcing metal strip without engaging the reinforcing metal strips.

* * * * *